US008813381B2

(12) United States Patent
Platt

(10) Patent No.: US 8,813,381 B2
(45) Date of Patent: Aug. 26, 2014

(54) TEMPLATE FOR MULTIPLE OVERLAPPING SCALLOPS

(76) Inventor: Janet R. Platt, Highland, UT (US)

( * ) Notice: Subject to any disclaimer, the term of this patent is extended or adjusted under 35 U.S.C. 154(b) by 852 days.

(21) Appl. No.: 13/035,923

(22) Filed: Feb. 26, 2011

(65) Prior Publication Data

US 2012/0216734 A1 Aug. 30, 2012

(51) Int. Cl.
*A41H 3/01* (2006.01)
*D05B 97/12* (2006.01)

(52) U.S. Cl.
CPC . *D05B 97/12* (2013.01); *A41H 3/01* (2013.01)
USPC ..... 33/566; 33/12

(58) Field of Classification Search
CPC ..... A41H 3/00; A41H 3/01; B43L 13/205; D05B 97/12; G01B 3/14
USPC ..... 33/1 G, 11, 12, 492, 562, 563, 566
See application file for complete search history.

(56) References Cited

U.S. PATENT DOCUMENTS 2,245,313 A * 6/1941 Wilhite ..... 33/11
2,579,664 A * 12/1951 Gleasman ..... 33/492
4,502,232 A * 3/1985 Broders ..... 33/562
4,580,352 A * 4/1986 Wilson ..... 33/563
5,319,859 A * 6/1994 Smith ..... 33/563
5,966,824 A * 10/1999 Vazquez ..... 33/11
6,889,442 B2 * 5/2005 Bouvier ..... 33/563
6,944,963 B2 * 9/2005 Amaru ..... 33/566
7,393,640 B2 * 7/2008 Kumar et al. ..... 435/6.1
7,703,214 B2 * 4/2010 Platt ..... 33/11
8,186,072 B1 * 5/2012 Nethery ..... 33/565
8,397,396 B2 * 3/2013 Nethery ..... 33/566
2009/0083984 A1 * 4/2009 Platt ..... 33/492

* cited by examiner

*Primary Examiner* — Brad Bennett
(74) *Attorney, Agent, or Firm* — F. Chad Copier

(57) ABSTRACT

Templates that are used to create several connected overlapping scallops made from fabric, as well as methods for making and using such templates, are described. The templates described have a plurality of evenly spaced, alternating arcs formed or cut in opposite, parallel edges of a substrate, resulting in evenly spaced, alternating semicircular tabs located on the opposite, parallel edges of the substrate. In some embodiments, the template is a die that produces cut fabric in the shape of the template. The template may be used to cut or mark material into connected semicircular arcs that may be sewn and folded to make connected scallops that may be overlapping. The resulting scallops are of uniform size and spacing, and are connected.

17 Claims, 7 Drawing Sheets

TEMPLATE FOR MULTIPLE OVERLAPPING SCALLOPS

FIELD

This application relates generally to sewing templates and methods of making and using such templates. In particular, this application relates to templates that are used to create continuous overlapping scallops, as well as methods for making and using such templates and the continuous overlapping scallops.

BACKGROUND

Often, making quilts can involve tedious tasks such as cutting multiple pieces of fabric to be used in a quilt. Many times, these multiple pieces of fabric must be equal sizes to create patterns in the quilt. One such pattern involves making scallops, which are often used in borders. Scallop borders are generally semi-circles or arcs on the edges of sewn items such as quilts, baby blankets, clothing, etc. Scallops are usually evenly spaced along an edge of a quilt or blanket such that the edge has a wave effect.

Scallops are generally made with a single fabric with the scallops end-to-end. Cutting out each scallop and sewing them together to make a long scallop row is time consuming and requires precision. Overlapping scallops are desirable because they add depth to the sewing piece, but overlapping scallops more than doubles the time required for a single scallop row because the process for making the scallop row must be repeated and the rows precisely lined up to create the desired effect. Any variation from the desired alignment is noticeable and can cause significant time to repair, or the loss of the value of the quilt or piece being sewn.

Because of the time consuming nature and requirement of a highly skilled person to create an overlapping scallop border, quilts, blankets, and other projects with overlapping scallop borders are highly desirable. Similarly, people desiring to make a project with an overlapping scallop border do not undertake the project lightly due to the time and skill required.

SUMMARY

Templates that are used to create several continuous connected scallops and overlapping continuous connected scallops made from two pieces of material, as well as methods for making and using such templates, are described in this specification. Templates for making multiple overlapping scallops may include a generally planar substrate, and two opposing rows of a plurality of evenly spaced arcs formed in the substrate such that the apex of each of the plurality of arcs of one row is directly opposite the origin of at least one of the plurality of arcs in the other row.

The generally planar substrate may be a die and the plurality of evenly spaced opposing arcs may include blades extending from the substrate. Similarly, the two opposing rows of a plurality of evenly spaced arcs may form the periphery of two edges of the substrate. The template may include at least one center line guide formed in the substrate spaced evenly between the apexes of the plurality of evenly spaced arcs of one of the two opposing rows and the other of the two opposing rows. The template may also include a marking point formed in the substrate approximate to each point where two origins of the plurality of evenly spaced arcs meet.

The substrate may be made of metal, acrylic, and polycarbonate, or any other suitable material. The substrate may be configured to allow a cutting instrument to be moved along an outside perimeter to cut material placed under the substrate. The template may also be configured to be used as a pattern for cutting a plurality of scallops in a connected chain.

A exemplary embodiment of a method of forming overlapping rows of scallops in fabric using a template may include, providing at least two layers of fabric, and providing a cutting or marking template having two opposing rows of a plurality of evenly spaced arcs formed in the substrate such that the apex of each of the plurality of arcs of one row is directly opposite the origin of at least one of the plurality of arcs in the other row. At least two layers of fabric may be cut such that the fabric is cut into the shape of the cutting or marking template, which may then be formed into continuous connected scallops. In some embodiments, the cutting or marking template may be a die and the cutting performed using a die cut machine, or the cutting may be accomplished by moving a cutting instrument around the periphery of the cutting or marking template.

The cut two layers of fabric may then be sewn together generally along cuts corresponding to the two opposing rows of a plurality of evenly spaced arcs to form a plurality of opposing sewn arcs. One of the two layers may then be cut along a center line between the plurality of opposing sewn arcs. The two layers of fabric may then be inverted such that the plurality of opposing sewn arcs are turned inside-out, and a pusher may be inserted into each of the inverted plurality of opposing sewn arcs. The pusher may have a handle and an end with the same general shape as the plurality of opposing sewn arcs. The pusher may also be formed from polytetraflouroethylene.

BRIEF DESCRIPTION OF THE DRAWINGS

The following description can be better understood in light of Figures, in which.

Figure 1A:
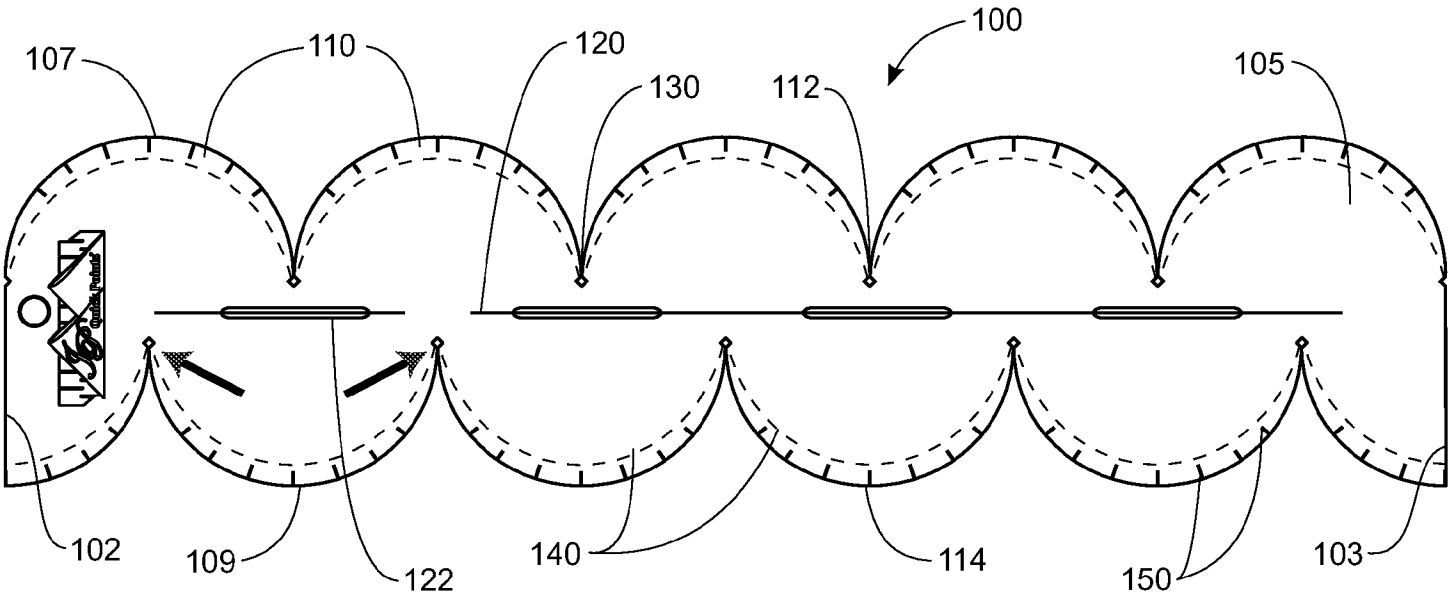
FIGS. 1A-1C illustrate exemplary devices for making continuous scallops, FIG. 1C being a close-up view of such device with printed instructions for using the illustrated Exemplary devices.

Together with the following description, the Figures demonstrate and explain the principles of the apparatus and methods for using the template for making scallops. In the Figures, the thickness and configuration of components may be exaggerated for clarity. The same reference numerals in different Figures represent the same component.

DETAILED DESCRIPTION

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on scallops for use in quilting, the apparatus and associated methods could be equally applied and adapted in other processes and fields, such as scrapbooking, greeting card making, and other creative arts.

Figure 2:
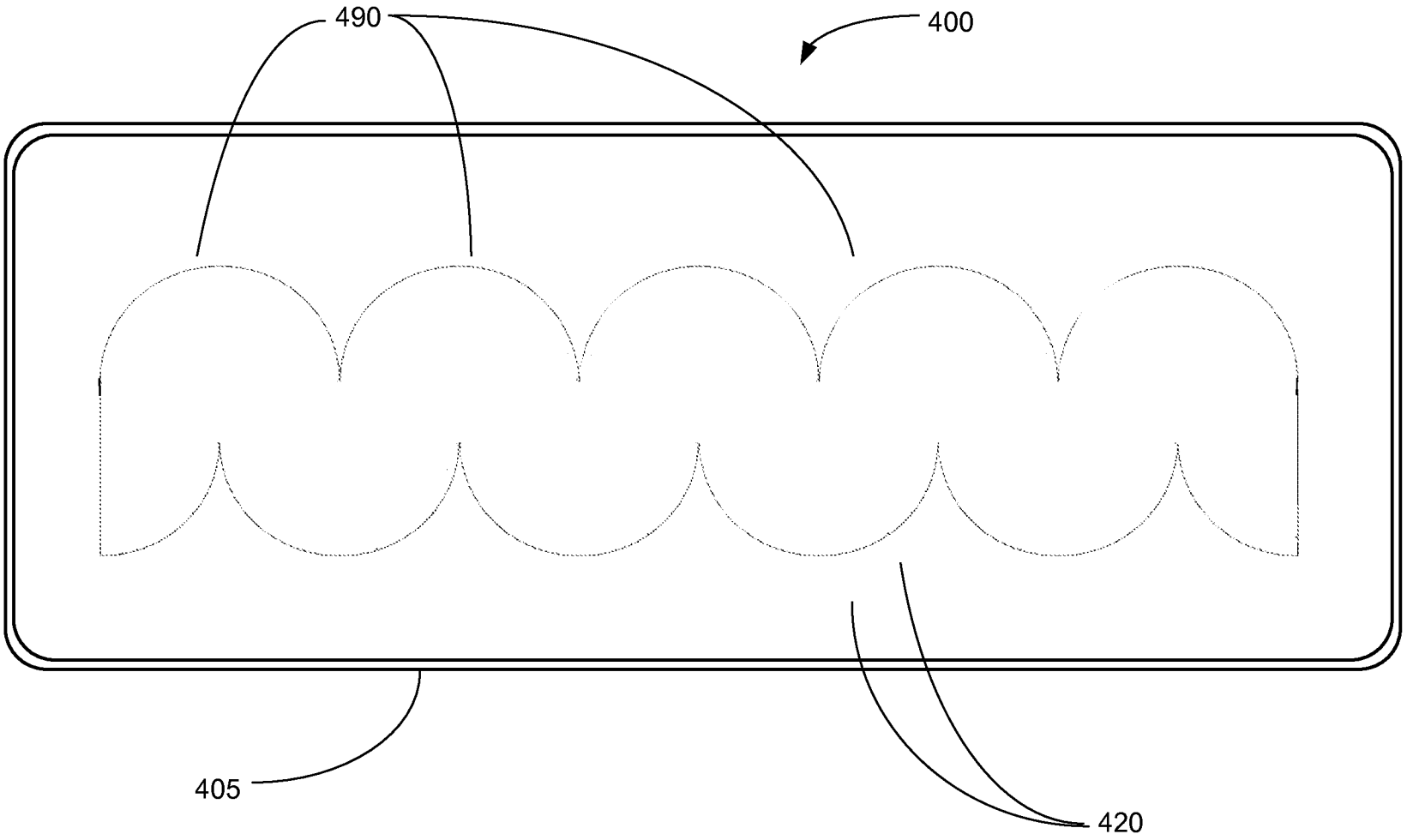
FIG. 2 illustrates an exemplary die cut template for making continuous overlapping scallops.
Figure 3:
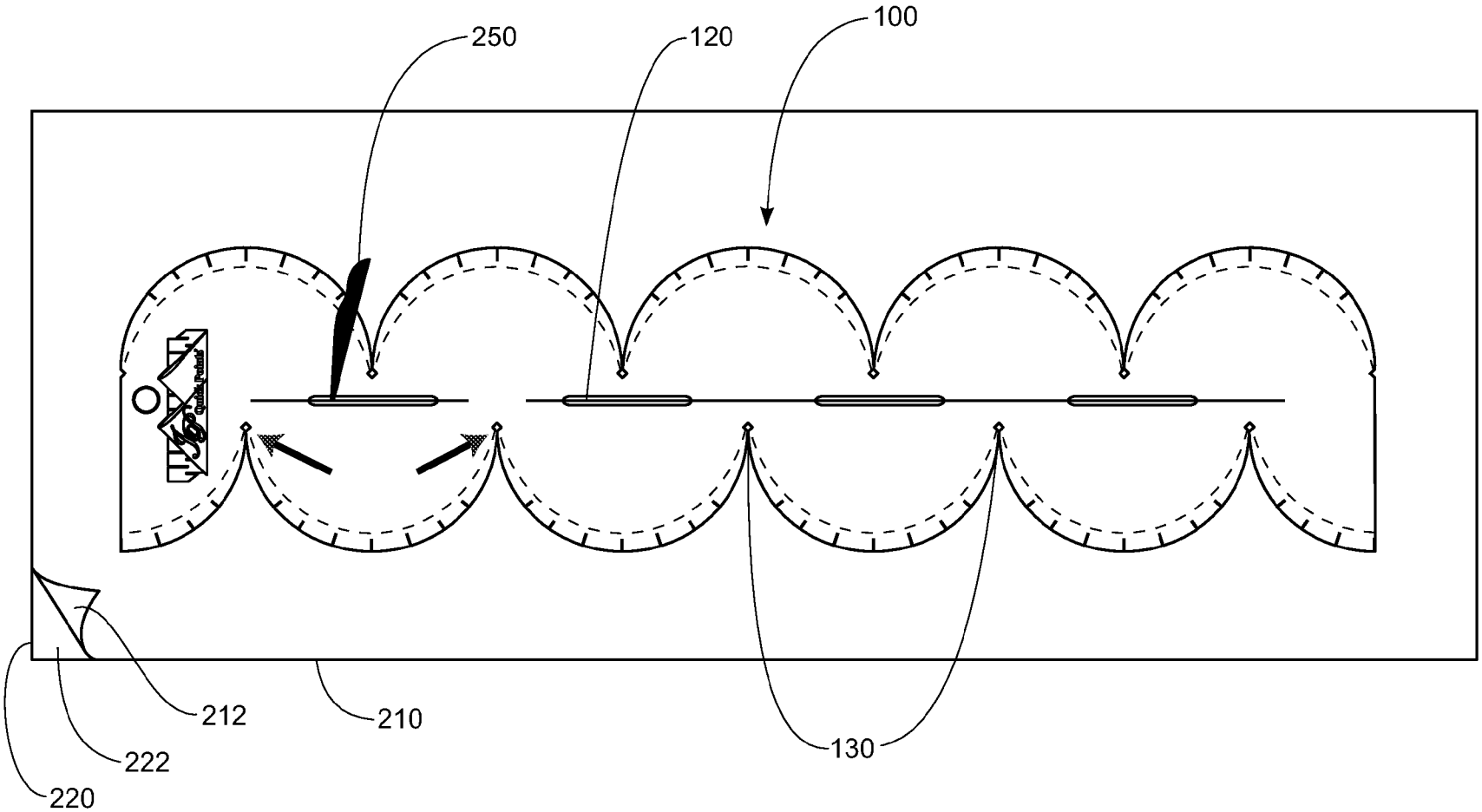
FIGS. 3-7 illustrate an exemplary method using the devices of FIGS. 1A-1B for making overlapping scallops.

The template for making a plurality of adjoined and overlapped scallops (hereinafter, "template") described in this application may have any configuration consistent with the scallop detail described below. One exemplary configuration of a template is illustrated in FIGS. 1A and 2. Template 100 includes a substrate 105 having two opposing sides 107, 109. Template 100 may also include arcs 110 formed in substrate 105. Arcs 110 may be evenly spaced such that a plurality of arcs 110 may be created on opposing sides 107, 109. Arcs 110 may be alternating between edges 107, 109 such that each origin 112 of arcs 110 is faced by the apex 114 of the arc 110 on the opposite side of substrate 105.

Arcs 110 may be dimensioned such that the arc is generally a half circle beginning at an origin 112 and extending to an apex 114 and proceeding to an adjacent origin 112 to form arc 110. Origins 112 may be allow sufficient space for an instrument to move along an outside edge of arc 110 and contact a surface or material (such as fabric 210, 220 shown in FIGS. 2-6) placed under template 100. Similarly, origins 112 may generally form an opening 130 in substrate 105 of sufficient width to allow a stylus to mark paper, or a writing instrument to mark on a material under template 100. For example, openings 130 may be between about 1 mm and 1 cm wide, depending on the size and configuration of the desired marking instrument.

Openings 130 may be rounded such that slot origins 112 may be wider than the space between arcs 110 at their closest point near origins 112. In some embodiments, origins 112 may simply terminate at the intersection of adjacent arcs 110 without and opening 130 for marking. In other embodiments, openings 130 may be about 4 times the width of the narrowest space between adjacent arcs 110. Openings 130 may form a semi-circle, a triangle, square, diamond, tear-drop shape, or any other functional shape to allow marking of origins 112.

Origins 112 may be located at a distance from centerline 120 to allow for a sewn border when the overlapping scallops are completed with the pattern. Center openings 122 in substrate 105 of template 100 may be provided that correspond to centerline 120 to allow for marking of centerline 120 on a material placed under template 100. Depending on the desired application, in some embodiments, each of origins 112 may be located at about the centerline 120 of template 100. In other embodiments, origins 112 may be offset from centerline 120 of template 100, such as is shown in FIG. 1A.

Template 100 may include any number of arcs 110 depending on the desired size and length of template 100 and any products created using template 100. For example, some embodiments may have as few as two arcs 110 on each side, while other embodiments may have 50 or more arcs 110. Template 100 may include ends 102, 103. Ends 102, 103 may be located perpendicular to centerline 120 and formed such that an origin 112 and an apex 114 of opposing arcs 110 form the extents of each of ends 102 and 103.

Markings may be printed on template 100 to provide instructions and details to a person using template 100. For example, seam line 140 may be provided to illustrate the general shape and location of a stitch line for forming scallops in fabric. Tick lines 150 may be provided on template 100 to illustrate where relief cuts should be made to allow for fabric to neatly accommodate within each scallop when sewn and inverted, as discussed below. Similarly, tick lines 150 may include an opening with a width to allow a rotary cutter or other instrument to make the relief cuts prior to sewing.

Figure 1B:
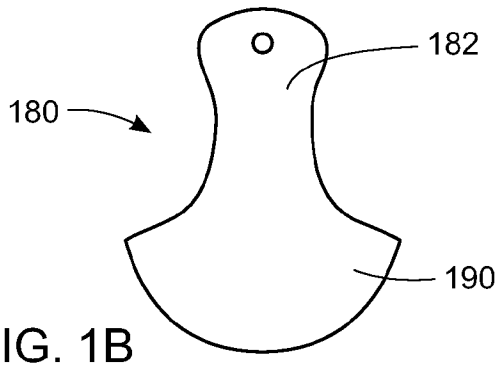

FIG. 1B illustrates pusher 180. Pusher 180 may include a handle 182 and an arc end 190. Arc end 190 may correspond to the shape and arc of seam line 140 and may be used to easily shape scallops after being sewn and inverted as described below. Pusher 180 may be formed of polytetraflouroethylene (PTFE) or other suitable material such as other plastics, metals, etc. PTFE may provide very little friction between fabric and pusher 180 to allow easy insertion and use of pusher 180 as described below.

Similarly, template 100 may be made from any material suitable for a template or template. For example, template 100 may be made of metals, plastics (such as acrylics, PTFE, polycarbonate, PVC, HDPE, resins, etc.), composite materials (such as fiberglass), paper, etc. In some embodiments, template 100 may include a durable top layer, resistant to cutting, and a soft lower layer for contacting and holding material to be cut in place. For example, template 100 made of metal may include a cork backing to help prevent template 100 from sliding on polyester fabric to be cut into scallops. Similarly, neoprene, rubber, plastics, or other material may be used as a bottom layer.

FIG. 2 illustrates an embodiment of a template for making connected scallops in the form of die template 400 having cutting blades 490 extending from substrate 405. Compressible material 420 may cover substrate 405 to reduce potential injury from cutting blades 490. Instructions for using die template 400 may be printed on the reverse of substrate 405. After using die template 400 with a die cutting machine to cut out fabric pieces, the instructions for forming continuous overlapping scallops may be substantially similar to instructions using template 100 as described below.

Figure 1C:
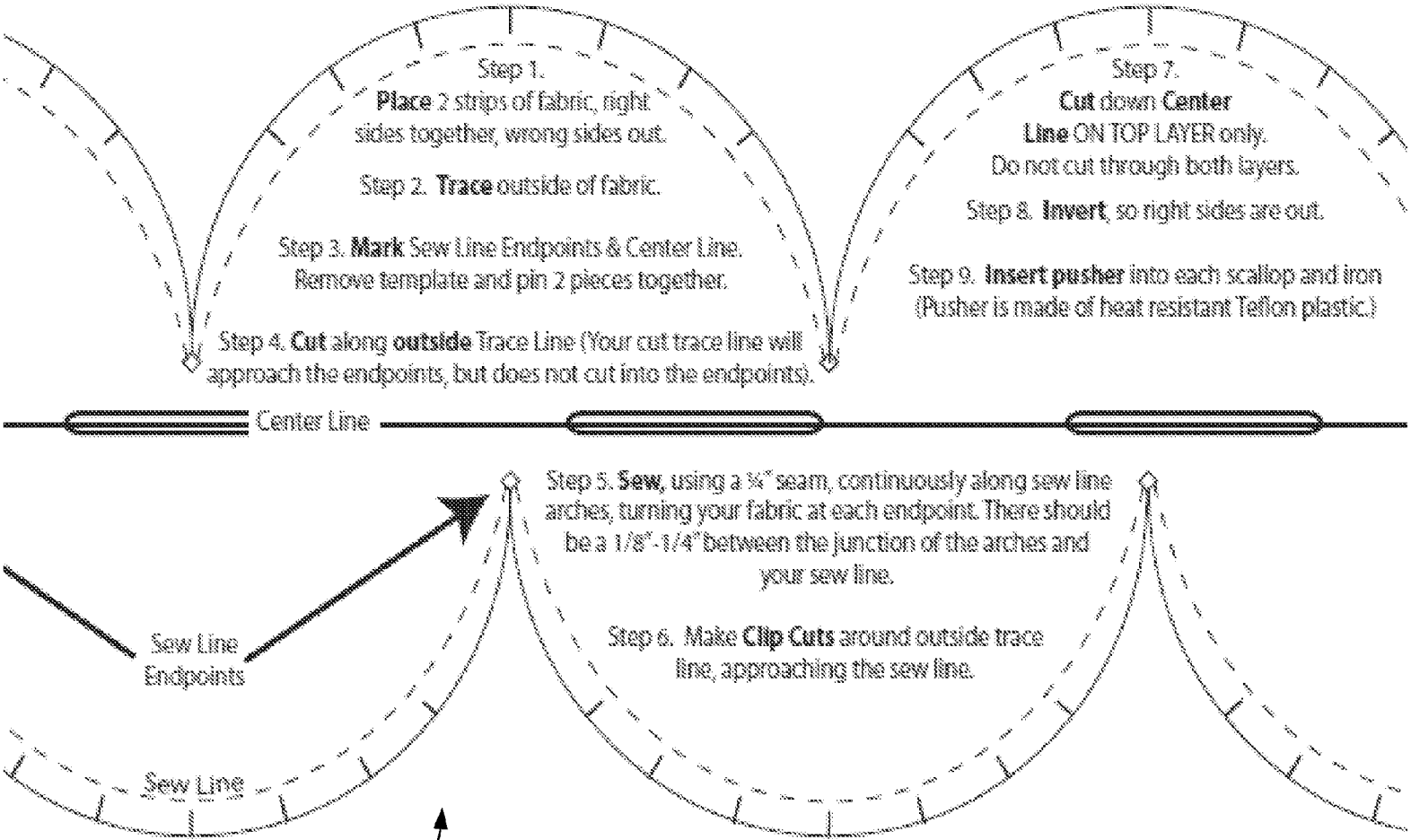

Embodiments of templates described in this document may be used with various materials such as paper in single layers to form single row scallops or overlapping scallops by cutting along the outside edge of the template or by using a template die cut and then folding the paper along a centerline to form overlapping, evenly spaced scallops. FIGS. 3-7 illustrate embodiments of a method of using template 100 to make overlapping scallops from fabric. Similarly, instructions to form overlapping scallops are shown as printed indicia on template 100 of FIG. 1C. Similar printed instructions may be included on the back side of die template 400 shown in FIG. 2.

In one embodiment, two strips of fabric 210, 220 larger than template 100 may be placed together with desired finished sides 212, 222 facing each other. Template 100 may then be placed on top of fabric 210, 220. Marking instrument 250 may be used to trace around the periphery of template 100 to make periphery trace 252 and in openings 130 of endpoints 112 and center openings 122 of centerline 120 to make centerline traces 254 on fabric 210. Marking instrument 250 may be any instrument suitable for marking the fabric 210, 220 or other material used to form scallops with template 100. Template 100 may then be removed and fabric 210, 220 pinned together. Fabric 210, 220 may then be cut with scissors 262 or cutting instrument 260, following periphery trace 252 to form cut-out fabric having the shape of template 100.

Figure 4:
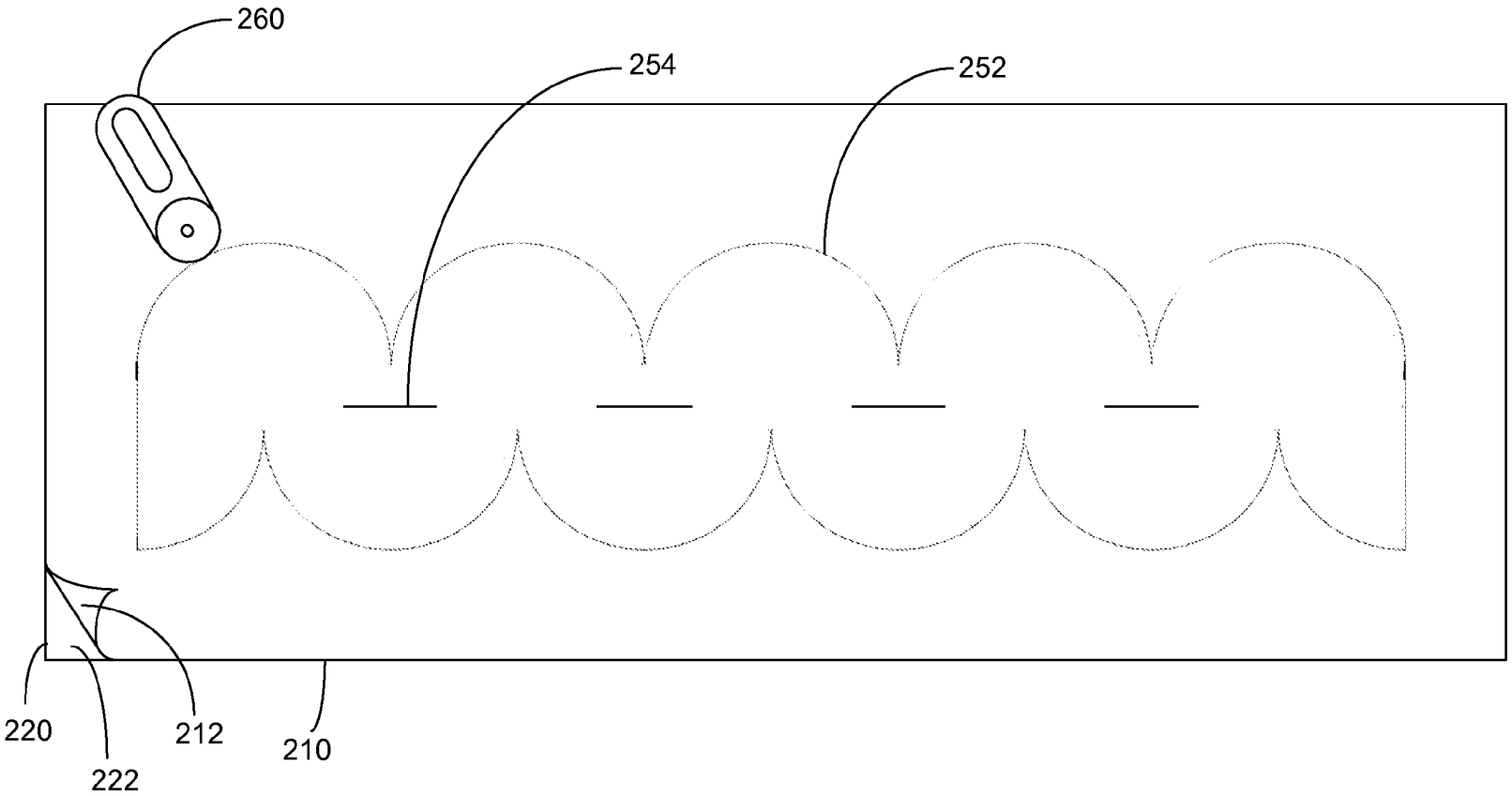

Alternatively, as shown in FIG. 4, cutting instrument 260 may be moved around the periphery of template 100 prior to removing template 100, and the resulting fabric pieces in the shape of template 100 may then be pinned together. Similarly, template 100 may be repeatedly placed along fabric 210, 220 to form a chain of scallops longer than template 100 by marking fabric 210, repositioning template 100 and then marking again, making sure to line up template 100 with prior marks. Additionally, fabric 210, 220 may be cut using die template 400 and a die cut machine without marking the fabric. The die cut pieces of fabric 210, 220 may then be pinned together and formed into continuous overlapping scallops as described below.

Figure 5:
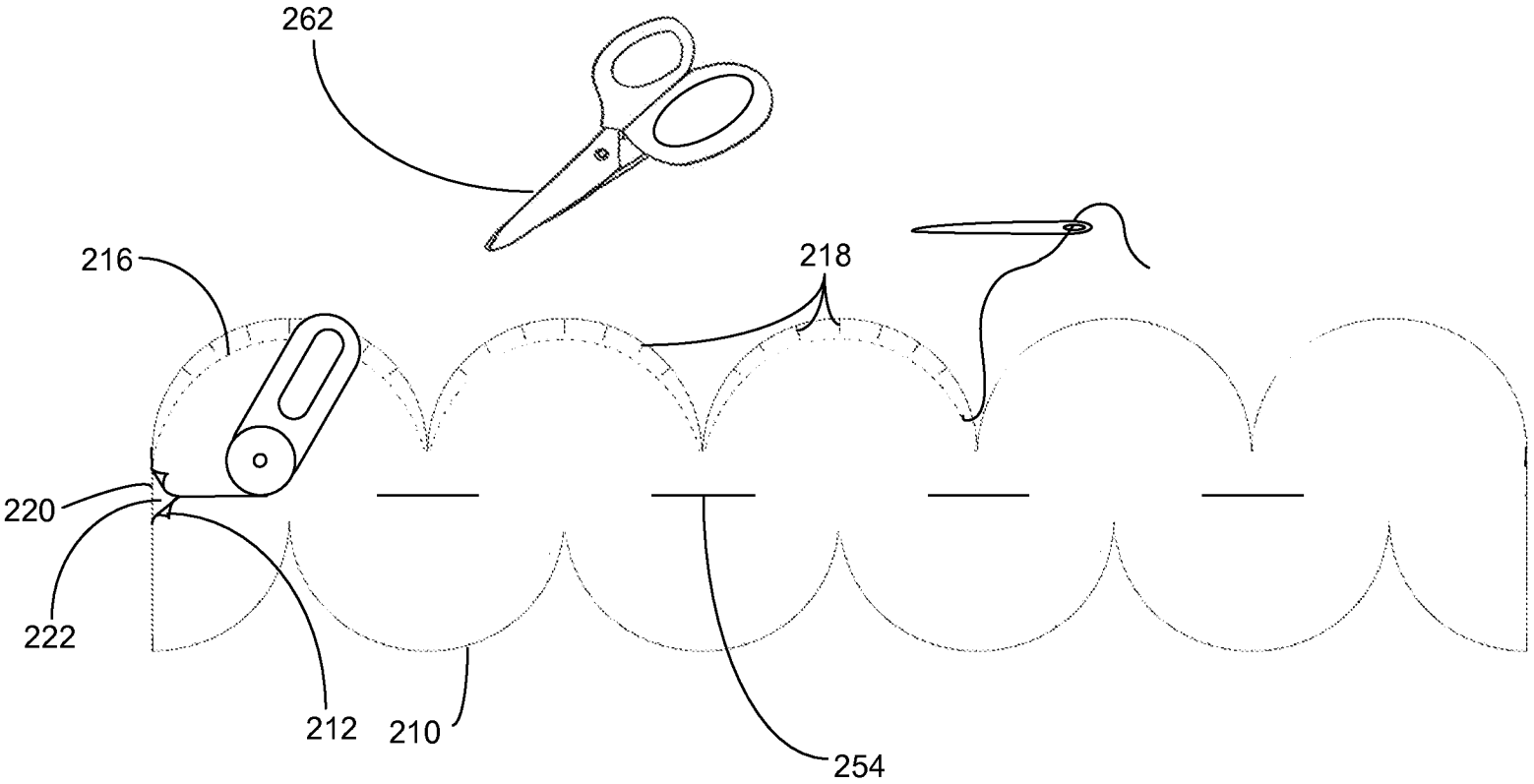

Once fabric pieces 210, 220 are cut with scissors 262 or other cutting instrument, they are sewn together with stitching 216 by generally following seam line 140 shown on template 100, or about ¼" seam between endpoints 112 to join fabric pieces 210, 220 into a single item (FIG. 5 shown as partially sewn for effect). Of course sewing fabric pieces 210, 220 together may be accomplished using any known sewing techniques or machines. Clip cuts or relief cuts 218 may then be made corresponding generally to relief cut marks 150 in template 100 with scissors 262 or other cutting instrument. Fabric layer 210 may then be cut along centerline marks 254 corresponding to centerline 130 of template 100. Each arc, or scallop 230, may then be inverted to generally form two evenly spaced opposite rows of scallops, with finished sides 212, 222 now exposed.

Figure 6:
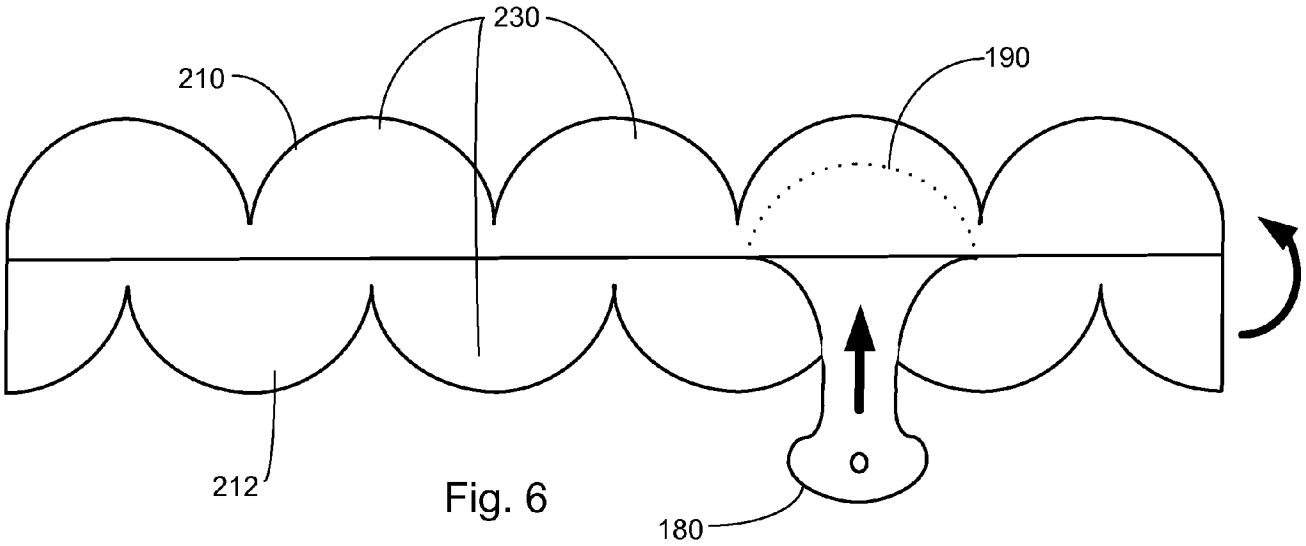
Figure 7:
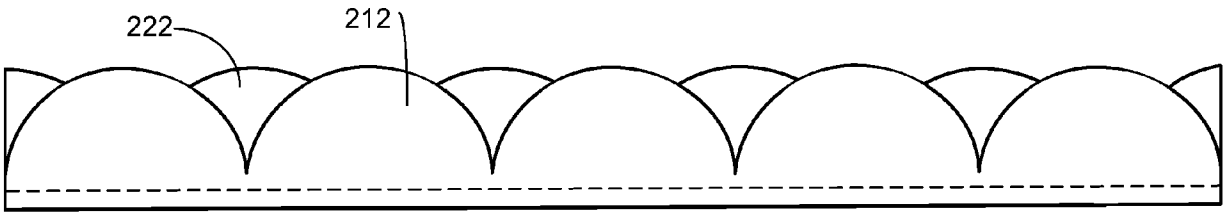

As shown generally in FIG. 6, pusher 180 may then be used to form each scallop 230 to the desired shape by placing pusher 180 into the pocket formed by sewing fabrics 210, 220 together and then inverting the sewn pieces. Each scallop 230 may be ironed with pusher 180 in position to hold a final shape in fabrics 210, 220. As shown in FIG. 7, the piece having two opposing rows of scallops may then be folded along centerline 214 and sewn to create continuous overlapping rows of scallops. When two different fabric patters or colors are used for fabrics 210, 220, the result is a row of scallops of one color/pattern on top with a second row having different color/pattern behind the first row. Both rows are automatically aligned to alternate.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use may be made without departing from the principles and concepts set forth herein. Also, as used herein, examples are meant to be illustrative only and should not be construed to be limiting in any manner.

The invention claimed is:

1. A device for making multiple overlapping scallops, comprising:

a generally planar substrate; and two opposing rows of a plurality of evenly spaced arcs formed in the substrate such that the apex of each of the plurality of arcs of one row is directly opposite the origin of at least one of the plurality of arcs in the other row.

2. The device of claim 1, wherein the generally planar substrate is a die and the plurality of evenly spaced opposing arcs include blades extending from the substrate.

3. The device of claim 1, wherein the two opposing rows of a plurality of evenly spaced arcs form the periphery of two edges of the substrate.

4. The device of claim 1, further comprising at least one center line guide formed in the substrate spaced evenly between the apexes of the plurality of evenly spaced arcs of one of the two opposing rows and the other of the two opposing rows.

5. The device of claim 1, further comprising a marking point formed in the substrate approximate to each point where two origins of the plurality of evenly spaced arcs meet.

6. The device of claim 1, wherein the substrate is made of one of metal, acrylic, and polycarbonate.

7. The device of claim 1, wherein the substrate is configured to allow a cutting instrument to be moved along an outside perimeter to cut material placed under the substrate.

8. The device of claim 1, wherein the device is configured to be used as a pattern for cutting a plurality of scallops in a connected chain.

9. A method of forming overlapping rows of scallops in fabric, the method comprising:

providing at least two layers of fabric; and providing a cutting or marking template having two opposing rows of a plurality of evenly spaced arcs formed in the substrate such that the apex of each of the plurality of arcs of one row is directly opposite the origin of at least one of the plurality of arcs in the other row.

10. The method of claim 9, further comprising, cutting the at least two layers of fabric such that the fabric is cut into the shape of the cutting or marking template.

11. The method of claim 10, wherein the cutting or marking template is a die and the cutting is performed using a die cut machine.

12. The method of claim 10, wherein the cutting is accomplished by moving a cutting instrument around the periphery of the cutting or marking template.

13. The method of claim 10, further comprising, sewing the two layers of fabric together generally along cuts corresponding to the two opposing rows of a plurality of evenly spaced arcs to form a plurality of opposing sewn arcs.

14. The method of claim 13, further comprising, cutting one layer of the two layers of fabric along a center line between the plurality of opposing sewn arcs.

15. The method of claim 14, further comprising:

inverting the two layers of fabric such that the plurality of opposing sewn arcs are turned inside-out; and inserting a pusher into each of the inverted plurality of opposing sewn arcs, the pusher having an end with the same general shape as the plurality of opposing sewn arcs.

16. The method of claim 15, wherein the pusher include a handle opposite the end with the same general shape as the plurality of opposing sewn arcs.

17. The method of claim 15, wherein the pusher is formed from polytetraflouroethylene.

* * * * *